US010376069B2

(12) United States Patent
Scrone-Smith

(10) Patent No.: US 10,376,069 B2
(45) Date of Patent: Aug. 13, 2019

(54) ADJUSTABLE VENUE SEATING APPARATUS AND DEVICES

(71) Applicant: Deborah Scrone-Smith, Ponte Vedra, FL (US)

(72) Inventor: Deborah Scrone-Smith, Ponte Vedra, FL (US)

( * ) Notice: Subject to any disclaimer, the term of this patent is extended or adjusted under 35 U.S.C. 154(b) by 0 days.

(21) Appl. No.: 15/863,921

(22) Filed: Jan. 6, 2018

(65) Prior Publication Data

US 2018/0192776 A1 Jul. 12, 2018

Related U.S. Application Data

(60) Provisional application No. 62/443,592, filed on Jan. 6, 2017.

(51) Int. Cl.

| | |
|---|---|
| ***A47C 7/66*** | (2006.01) |
| ***A45B 17/00*** | (2006.01) |
| ***A45B 11/00*** | (2006.01) |
| ***A47C 1/12*** | (2006.01) |

(52) U.S. Cl.

CPC ..... *A47C 7/66* (2013.01); *A45B 11/00* (2013.01); *A45B 17/00* (2013.01); *A47C 1/12* (2013.01)

(58) Field of Classification Search

CPC ..... A47C 7/66; A45B 11/00

See application file for complete search history.

(56) References Cited

U.S. PATENT DOCUMENTS

| | | | | | |
|---|---|---|---|---|---|
| 1,211,527 | A | * | 1/1917 | Berndt | A47B 23/046 108/8 |
| 2,559,421 | A | * | 7/1951 | Garrett | A45B 11/00 108/50.12 |
| 3,050,280 | A | * | 8/1962 | Regan | A45B 11/00 135/90 |
| 3,879,086 | A | * | 4/1975 | Moceri | A45B 11/00 135/16 |
| 4,300,798 | A | * | 11/1981 | Musgrove | A47C 7/68 297/162 |
| 4,641,883 | A | * | 2/1987 | Kato | A47G 9/1045 297/118 |
| 5,441,067 | A | * | 8/1995 | James | A47C 7/66 135/128 |

(Continued)

FOREIGN PATENT DOCUMENTS

FR 609843 A * 8/1926 ..... A47C 7/66

*Primary Examiner* — Noah Chandler Hawk

(74) *Attorney, Agent, or Firm* — Wilson Dutra, PLLC; Camille A. Wilson

(57) ABSTRACT

The present disclosure provides generally for an adjustable venue seating apparatus that may provide covering from ambient conditions. According to the present disclosure, an adjustable venue seating apparatus may allow a user to have flexibility for protection in a range of ambient conditions without having to change the type of covering device. In some aspects, an adjustable venue seating apparatus may be integrated temporarily or permanently into venue seating, such as a sports stadium or concert amphitheatre. In some embodiments, adjustable venue seating may need to be customized to the specifications of a venue, allowing for the enjoyment and safety of a user of the adjustable venue seating apparatus and surrounding attendees who may or may not have the adjustable venue seating apparatus on their seat.

18 Claims, 15 Drawing Sheets

(56) References Cited

U.S. PATENT DOCUMENTS

| | | | | |
|---|---|---|---|---|
| 6,293,292 | B1 * | 9/2001 | Watzke | A47C 7/66<br>135/123 |
| 6,405,742 | B1 * | 6/2002 | Driscoll | A45B 11/00<br>135/20.1 |
| 7,614,264 | B2 * | 11/2009 | McGettrick | E05B 9/08<br>248/553 |
| 9,060,613 | B2 * | 6/2015 | Combs | A47C 7/021 |
| 2004/0112414 | A1 * | 6/2004 | Palmer | A45B 11/00<br>135/19 |
| 2017/0009482 | A1 * | 1/2017 | Remolina | E04H 15/34 |
| 2017/0342737 | A1 * | 11/2017 | Cooley | E04H 12/2238 |

* cited by examiner

ADJUSTABLE VENUE SEATING APPARATUS AND DEVICES

CROSS-REFERENCE TO RELATED APPLICATION

This application claims priority to and the full benefit of U.S. Provisional Patent Application Ser. No. 62/443,592, filed Jan. 6, 2017, and titled "RESPONSIVE UMBRELLA APPARATUS AND DEVICES", the entire contents of which are incorporated herein by reference.

BACKGROUND OF THE DISCLOSURE

From palm leaves to hats on sticks, umbrellas or parasols were traditionally used as a covering from rain or sunlight. The difference between these two typically is the material used for the covering material, since certain parasols are not waterproof. Generally, umbrellas are collapsible with bendable joints allowing for extension or retraction of the covering. This foldable mechanism typically consists of a central pole, which can be made of wood, metal, or plastic. The pole can have wooden or metal ribs to support the foldable covering. An umbrella may be a hand-held device designed for personal, portable use or may be a larger object designed to be stationary in a particular location.

Despite the sophistication and range of umbrella solutions available, umbrellas and parasols continue to have issues that have plagued them since the inception of their creation. These include dealing with harsher environmental elements, such as wind, hail, or sleet; being responsive to a user's need in the moment; and integrating on-demand or predictive functionality. Further, umbrellas continue to be limited on how to address perpendicular or vertical rainfall that is affected by wind and falls on an umbrella holder at an angle.

Outdoor stadiums, venues, sporting events, and entertainment events have struggled to develop a solution for its attendees that can protect them from the elements. Barring a complete redesign in their infrastructure, such as a new complex or building, most venues are left with whatever solutions they may have on hand to address a common complaint attendees have: protection from the sun or protection from poor weather conditions. Attendees are left with either trying to plan for the uncertain, such as bring ponchos or hats to an event, or depending on a venue for a solution to their needs.

Certain venues may have further complications developing these solutions, such as creating something that integrates within the existing framework of venue seating, meets attendee's expectations, and is not disruptive to the experience they attended for. In some instances, a solution may address one of these needs, but not all three. Venues have struggled to develop a solution that is able to improve the attendee experience without needing to make deeper changes to what they have already invested in.

SUMMARY OF THE DISCLOSURE

What is needed is an adjustable venue seating apparatus to shield attendees from the elements while also being able to dynamically respond to their needs or emergency circumstances. In some embodiments, the adjustable venue seating apparatus may be customizable to the needs of a venue, fitting within any preexisting framework to cover attendees. The adjustable venue seating apparatus may come in a variety of forms to fit into any preexisting framework. The adjustable venue seating apparatus may also include a portable delivery device to contain and store the adjustable venue seating apparatus after use. In some implementations, the adjustable venue seating apparatus may be adaptable to fit the needs of an attendee or any guidelines set by a venue. In some aspects, the adjustable venue seating apparatus may have a security lock so that only the venue can install and remove the adjustable venue seating apparatus.

An adjustable venue seating apparatus is a venue-wide solution that may allow spectators to protect themselves from the elements as they enjoy the event. The present disclosure further relates to an adjustable venue seating apparatus that may be permanently or temporarily integrated into venue seating, on an individual basis or as a venue feature. Venue seating presents a unique set of issues as venues typically aim to maximize capacity and obstructed views negatively affect enjoyment of the event. Accordingly, an adjustable venue seating apparatus may be able to adjust to limit view obstruction for the individual and those around him.

What is also needed is a responsive umbrella that offers a full suite of functionality and variation to meet a user's needs either ahead of time or in the moment. The responsive umbrella combines an umbrella framework, which includes a stem, covering, panels, and ribs, with the needs a user has at any given moment. A rim is also included to increase the stability of the umbrella itself and to give a user more protection against the unpredictability of the elements. A responsive umbrella will resolve common issues users have when handling an umbrella, such as being able to hold it while carrying various other items, or being adaptable to a particular situation or task.

According to some embodiments of the present disclosure, an adjustable seating apparatus may comprise a seat attachment mechanism attachable to venue seating; a visor configured to shield at least a portion of ambient elements for a user seated in the venue seating when the adjustable seating apparatus is in a default engaged state; an arm connecting the visor to the seat attachment mechanism; and a locking mechanism configured to secure the seat attachment mechanism to the venue seating.

In some aspects, the visor may comprise a flat surface. In some embodiments, the visor may comprise a kinked or angled surface. In some implementations, the visor may comprise a rigid material. In some aspects, the visor may comprise a collapsible material, wherein collapsing the visor may limit an ability to shield at least the portion of ambient elements.

In some embodiments, the arm may comprise a kinked configuration. In some implementations, the locking mechanism may comprise a release mechanism that may allow for removal of the adjustable seating apparatus. In some aspects, the release mechanism may comprise a magnetic release mechanism.

In some embodiments the adjustable seating apparatus may comprise a visor attachment mechanism configured to attach the visor to the arm. In some implementations, the arm may comprise a tubing configured to accept the visor attachment mechanism. In some aspects, the adjustable seating apparatus may comprise a first adjustment mechanism configured to adjust a height from the seat attachment to the visor. In some embodiments, the first adjustment mechanism may adjust an extension of the visor attachment mechanism.

In some aspects, the adjustable seating apparatus may comprise a second adjustment mechanism configured to adjust a lateral angle from the arm to the visor. In some implementations, the adjustable seating apparatus may comprise a third adjustment mechanism configured to adjust a vertical angle from the arm to the visor. In some embodiments, the third adjustment mechanism may allow for adjustment for a range between the default engaged state and a collapsed state, wherein the visor is substantially parallel to the arm.

In some aspects, the adjustable seating apparatus may comprise a safety release mechanism configured to respond to an emergency condition. In some embodiments, the emergency condition may comprise the user standing up. In some implementations, the emergency condition may comprise an object placed on the visor. In some aspects, the safety release mechanism may allow for a temporary vertical angle adjustment extending beyond the default engaged state. In some embodiments, the safety release mechanism may place the adjustable seating apparatus in a collapsed state.

BRIEF DESCRIPTION OF THE DRAWINGS

The accompanying drawings, that are incorporated in and constitute a part of this specification, illustrate several embodiments of the disclosure and, together with the description, serve to explain the principles of the disclosure.

DETAILED DESCRIPTION

The present disclosure provides generally for an adjustable venue seating apparatus that may provide covering from ambient conditions. According to the present disclosure, an adjustable venue seating apparatus may allow a user to have flexibility for protection in a range of ambient conditions without having to change the type of covering device. In some aspects, an adjustable venue seating apparatus may be integrated temporarily or permanently into venue seating, such as a sports stadium or concert amphitheatre. In some embodiments, adjustable venue seating may need to be customized to the specifications of a venue, allowing for the enjoyment and safety of a user of the adjustable venue seating apparatus and surrounding attendees who may or may not have the adjustable venue seating apparatus on their seat.

In the following sections, detailed descriptions of examples and methods of the disclosure will be given. The description of both preferred and alternative examples, though thorough, are exemplary only, and it is understood to those skilled in the art that variations, modifications, and alterations may be apparent. It is therefore to be understood that the examples do not limit the broadness of the aspects of the underlying disclosure as defined by the claims.

Glossary

Adjustable venue seating apparatus: as used herein refers to a device customized to be installed or used in conjunction with venue seating that may shield a user from one or more ambient conditions, such as sun exposure, wind, rain, light, or sound, as non-limiting examples, wherein the device may adjust based on the ambient conditions, such as through manual control, automatic detection and control, or pre-programmed responsiveness programmed by the user or manufacturer. In some embodiments, an adjustable venue seating apparatus may be installed individually on venue seating or in groups over sections or portions of the venue seating. In some aspects, adjustable venue seating may be customized to the specifications of the venue seating, wherein the adjustable aspects may be limited to allow for the enjoyment and safety of users of the adjustable venue seating apparatus and surrounding attendees.

Venue seating: as used herein refers to mass organized seating that tends to be static. As opposed to normal seating, there is a relationship between proximate seats and the uniformity and spacing between seats in front of, behind, and to the side of an attendee's seat. Venue seating accounts to this type of relational grouping when compared to normal seating.

Responsive umbrella: as used herein refers to any personal device that may shield a user from one or more ambient conditions, such as sun exposure, wind, rain, light, or sound, as non-limiting examples, wherein the device may adjust based on the ambient conditions, such as through manual control, automatic detection and control, or pre-programmed responsiveness programmed by the user or manufacturer.

Figure 1:
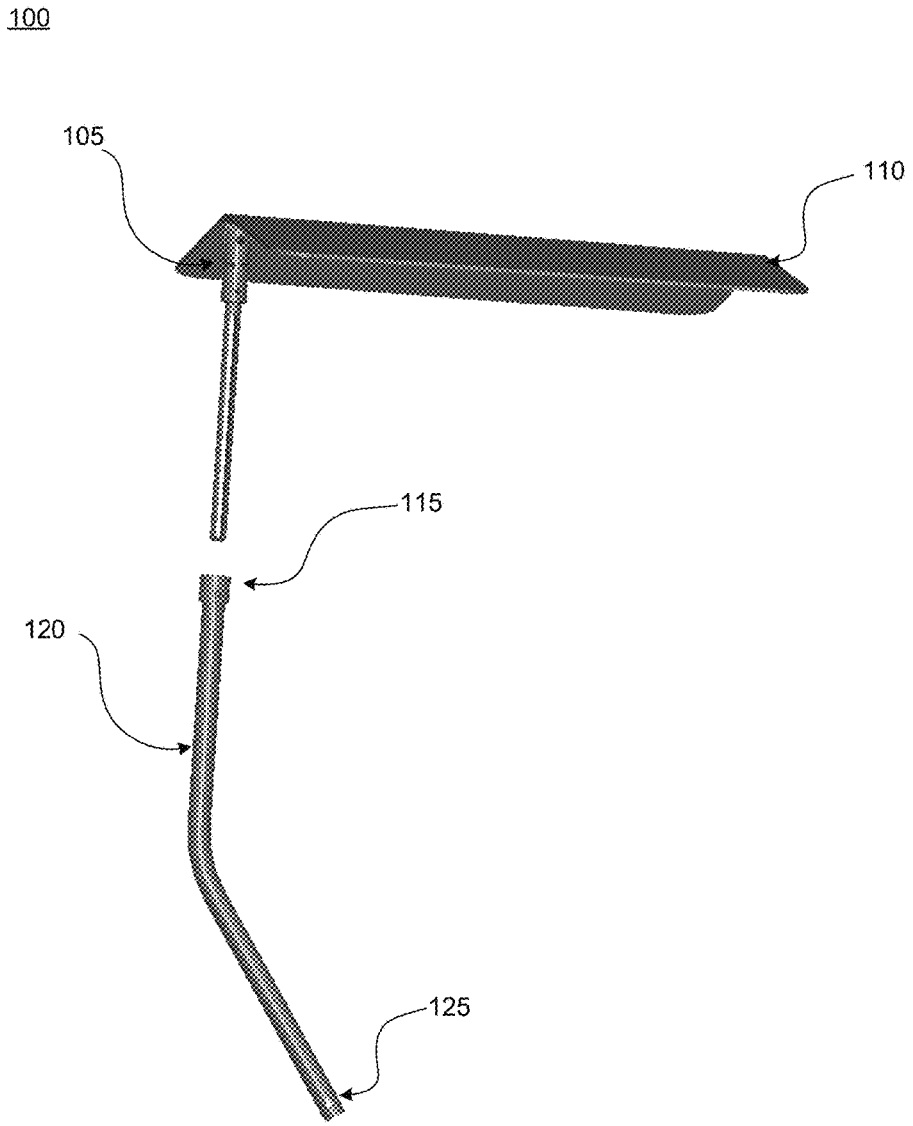
FIG. 1 illustrates an exemplary embodiment of an adjustable venue seating apparatus according to some embodiments of the present disclosure.

Referring now to FIG. 1, an exemplary adjustable venue seating apparatus 100 is illustrated. In some embodiments, an adjustable venue seating apparatus 100 may include an angle adjustment mechanism 105, a visor 110, a height adjustment mechanism 115, an arm 120, and an arm attachment mechanism 125. In some aspects, the height adjustment mechanism 115 may allow for vertical adjustment, such as for users of different heights. In some embodiments, the angle adjustment mechanism 105 may allow for one or both lateral and vertical angle adjustments. In some implementations, the angle adjustment mechanism 105 may allow for the tilting of the visor 110, such as to allow for the changing position of the sun. In some aspects, the angle adjustment mechanism 105 may allow for vertical angle adjustment, such as between a collapsed state and a default engaged position, wherein a collapsed state may comprise the visor 110 resting substantially parallel to the arm 120, such as illustrated in FIG.2C. In some embodiments, the range of vertical angle adjustment may be set by a venue, such as to protect the safety and viewing experience of nearby attendees.

In some implementations, an angle adjustment mechanism 105 may offer a range of motion for an attendee, which may allow for adjustment throughout an event based on the ambient conditions. In some aspects, an angle adjustment mechanism 105 may have a ball and socket to facilitate the range of motion. In some embodiments, an angle adjustment mechanism 105 may have a fixed range of motion. In some implementations, an angle adjustment mechanism 105 may click into specific angles for adjustments. In some aspects, an angle adjustment mechanism 105 may include a base and an insert. In some embodiments, an angle adjustment mechanism 105 may click into a base. In some implementations, an angle adjustment mechanism 105 may be installed into a base. In some aspects, an angle adjustment mechanism 105 may be attached to a visor 110. In some embodiments, an angle adjustment mechanism 105 may use a clevis fastener. In some implementations, an angle adjustment mechanism 105 may use a rivet to allow for a hinge design element.

In some embodiments, a visor 110 may be a flat surface. In some implementations, a visor 110 may be an angled surface. In some aspects, the shape of a visor 110 may be adjusted by an attendee. In some embodiments, the shape of a visor 110 may only be adjusted by a venue. In some implementations, a visor 110 may be contoured to a venue's specifications. In some aspects, a visor 110 may tilt in coordination with an angle adjustment mechanism 105. In some implementations, a visor 110 may be angled in accordance to any venue specifications, such as sightline requirements as a non-limiting example. In some embodiments, a visor 110 may be semi-rigid to allow for more flexibility.

In some implementations, a visor may connect to a hinge that allows it to move upwards and downwards. In some aspects, a visor 110 may move according to the needs of an attendee, such as wherein one or both the angle adjustment mechanism 105 and the height adjustment mechanism 115 may comprise a function that may be responsive to an emergency condition. For example, an attendee may be at a sporting event. During the sporting event, an event may occur on the field where the venue's attendees all stand up in celebration. The emergency condition may be the sudden rise of the attendee, and the visor 110 may swing upwards to allow for that motion, such as illustrated in FIG. 3C. Once the attendee sits back down, the visor 110 may return to the default engaged position or may fall into a collapsed state, such as illustrated in FIG. 2C. In some embodiments, the tilt design may incorporate a titan screw to allow for tactile feedback. In some implementations, a ball plunge design may be used for the tilt design feature.

In some embodiments, a visor 110 may be made of a pliable, weatherproof, or durable material. By way of non-limiting examples, a visor 110 may be made of plastic optical fiber; thermoplastics such as polyethylene, polypropylene, polystyrene, or polyvinyl chloride; a material or alloy that allows for casting, such as aluminum casting; or materials that allow for an injection molding, such as metals, glasses, elastomers, confections, or polymers. In some implementations, a visor 110 may have rounded edges to enhance a material's low thermal capabilities.

In some embodiments, an adjustable venue seating apparatus 100 may include a height adjustment mechanism 115. In some implementations, a height adjustment mechanism 115 may connect to an angle adjustment mechanism 105. In some aspects, a height adjustment mechanism 115 may have a telescoping feature to adjust the adjustable venue seating apparatus 100 height range.

In some embodiments, an arm 120 may connect to a height adjustment mechanism 115. In some implementations, an arm 120 may support an adjustable venue seating apparatus 100. In some aspects, an arm attachment mechanism 125 may connect an arm 120 to a stable structure. For example, an arm 120 may connect to venue seating. In some embodiments, the adjustable venue seating apparatus 100 may comprise an adjustment toggle that may allow an attendee to manually adjust the settings, which may be one or both mechanical or electronic. As non-limiting examples, an adjustment toggle may comprise a bar, a button, a knob, a dial, or combinations thereof.

Figure 2A:
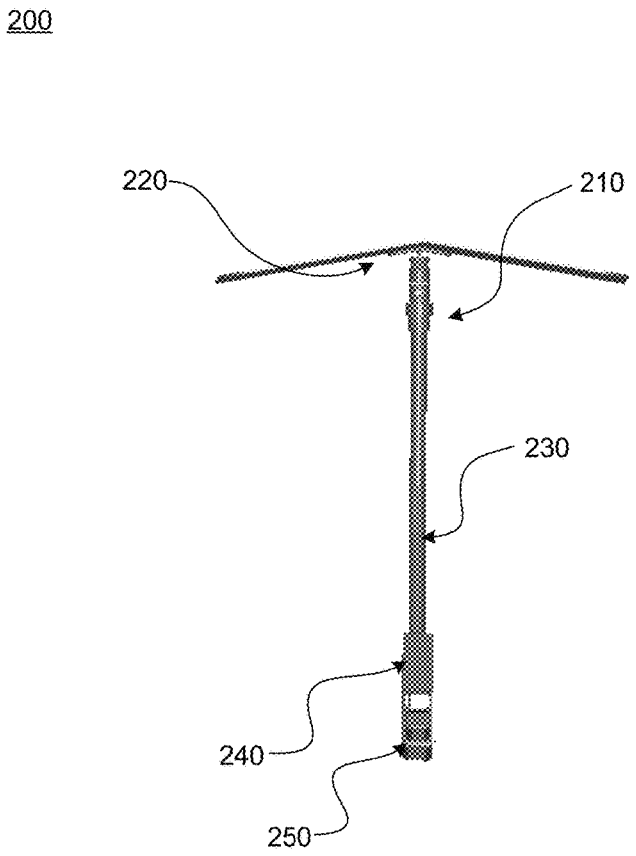
FIG. 2A illustrates a front view of an exemplary adjustable venue seating apparatus with a locking mechanism according to some embodiments of the present disclosure.
Figure 2B:
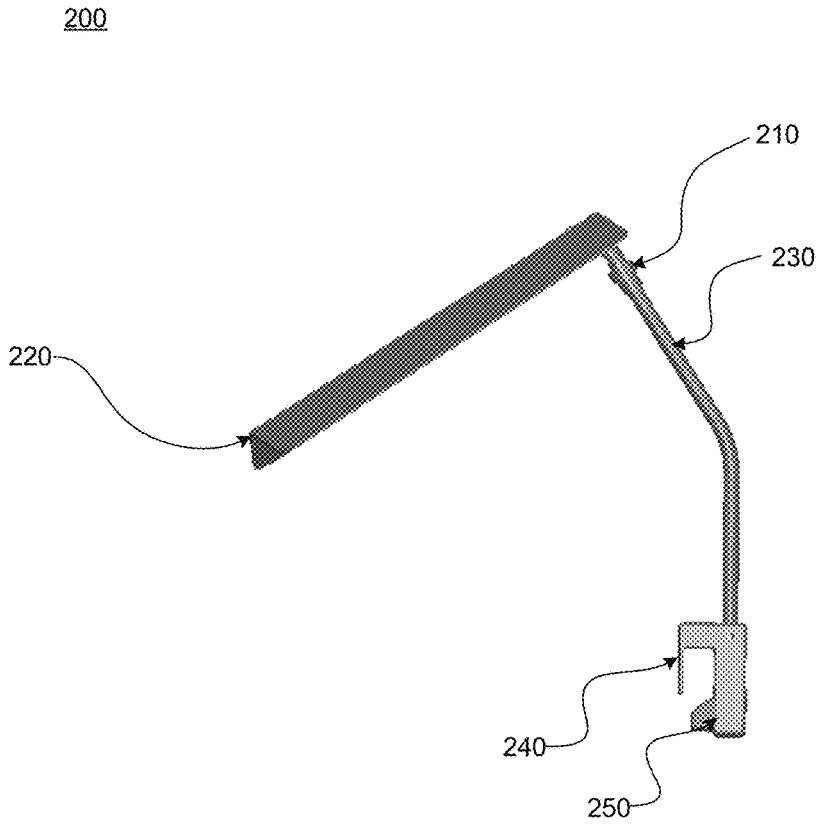
FIG. 2B illustrates a side view of an exemplary adjustable venue seating apparatus with a locking mechanism according to some embodiments of the present disclosure.
Figure 2C:
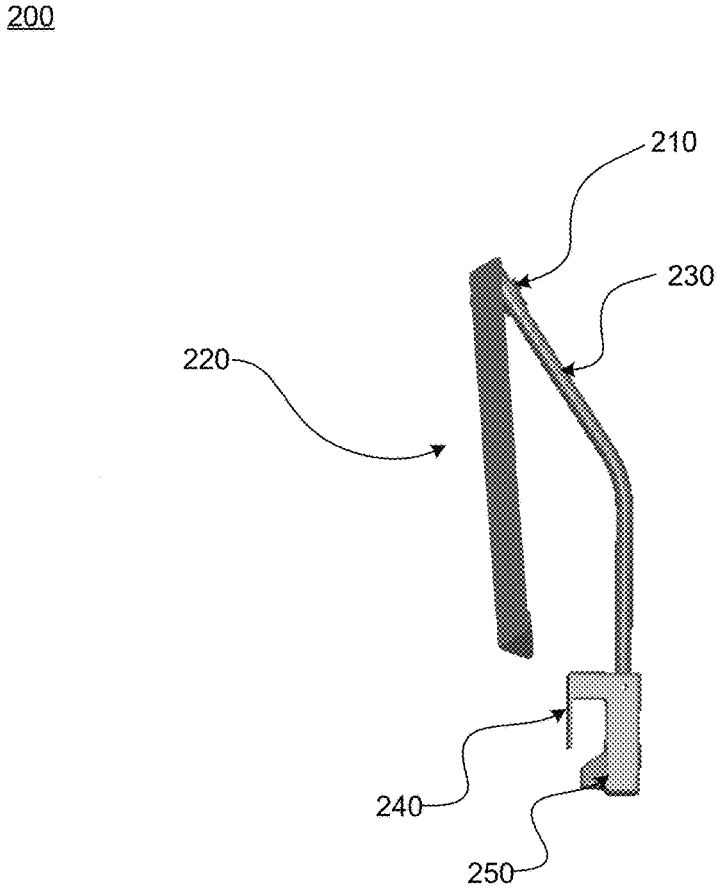
FIG.2C illustrates a side view of an exemplary adjustable venue seating apparatus in a collapsed state according to some embodiments of the present disclosure.

Referring now to FIGS. 2A-2C, an exemplary adjustable venue seating apparatus 200 with a locking mechanism 250 is illustrated. In some embodiments, an adjustable venue seating apparatus 200 may include an adjustment mechanism 210, a visor 220, an arm 230, an attachment mechanism 240, and a locking mechanism 250. In some aspects, the visor 220 may be collapsible, wherein the collapsing of the visor 220 may limit its ability to protect an attendee from the elements. For example, the visor 220 may comprise a tube that may contain a rolled material, wherein the rolled material may be extended and locked into place to engage the visor 220. In some embodiments, a collapsible visor 220 may allow for reduced impediment of visibility for surrounding attendees and an option where an attendee may disengage the adjustable venue seating apparatus 200. In some aspects, the visor 220 may comprise a safety release function, which may collapse the visor 220 when an emergency condition is detected, such as illustrated in FIG.3C. In some embodiments collapsing the visor 220 may place the adjustable venue seating apparatus in a collapsed state as illustrated in FIG. 2C.

In some implementations, an adjustment mechanism 210 may attach to a visor 220 and an arm 230. In some aspects, an adjustment mechanism 210 may have a ball and socket to facilitate the range of motion. In some embodiments, an adjustment mechanism 210 may have a fixed range of motion. In some implementations, an adjustment mechanism 210 may click into specific or preset angles. In some aspects, an adjustment mechanism 210 may include a base and an insert. In some embodiments, an adjustment mechanism 210 may click into a base. In some implementations, an adjustment mechanism 210 may be installed into a base. In some embodiments, an adjustment mechanism 210 may use a clevis fastener. In some implementations, an adjustment mechanism 210 may use a rivet to allow for a hinge design element.

In some aspects, a visor 220 may tilt in coordination with an adjustment mechanism 210. In some embodiments, the tilt design may incorporate a titan screw to allow for tactile feedback. In some implementations, a ball plunge design may be used for the tilt design feature. In some implementations, a visor 220 may be angled in accordance to any venue specifications, such as sightline requirements as a non-limiting example. In some embodiments, a visor 220 may be semi-rigid to allow for more flexibility.

In some implementations, an adjustment mechanism 210 may connect to an arm 230. In some implementations, an arm 230 may support an adjustable venue seating apparatus 200. In some aspects, an arm 230 may connect to a stable structure, like venue seating. In some embodiments, an arm 230 may connect to an attachment mechanism 240.

In some implementations, an attachment mechanism 240 may connect to a locking mechanism 250. In some aspects, a locking mechanism 250 may anchor an adjustable venue seating apparatus 200 into place. In some embodiments, a locking mechanism 250 may slide over venue seating. In some implementations, a locking mechanism 250 may click into place. In some aspects, a locking mechanism 250 may be permanently installed by a venue. In some embodiments, a locking mechanism 250 may use a key fob to be unlocked. In some implementations, a locking mechanism 250 may only be unlocked by a venue. In some aspects, a locking mechanism 250 may conform to venue seating as it is placed. In some embodiments, a locking mechanism 250 may be integrated into venue seating itself, with a separate adjustable venue seating apparatus, such as the one described in FIG. 1, installed into the locking mechanism 250. In some implementations, a locking mechanism 250 may be a holder for an adjustable venue seating apparatus 200.

Figure 3A:
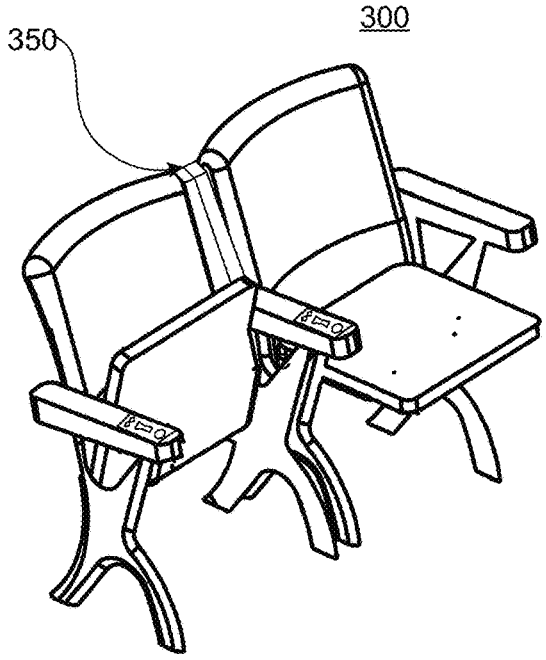
FIG. 3A illustrates venue seating with an exemplary adjustable seating apparatus pocket.
Figure 3B:
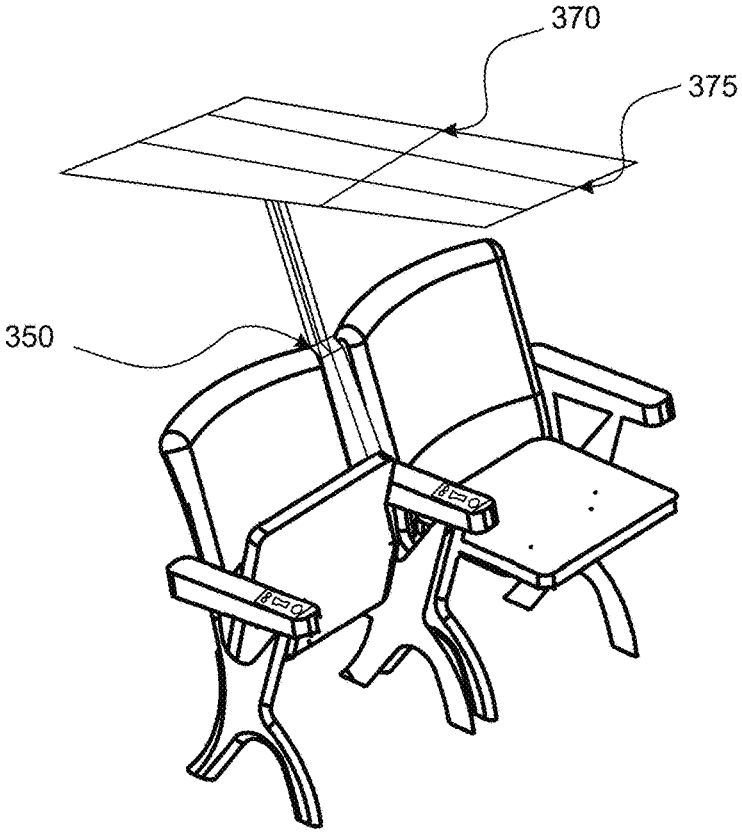
FIG. 3B illustrates venue seating with an exemplary adjustable seating apparatus.
Figure 3C:
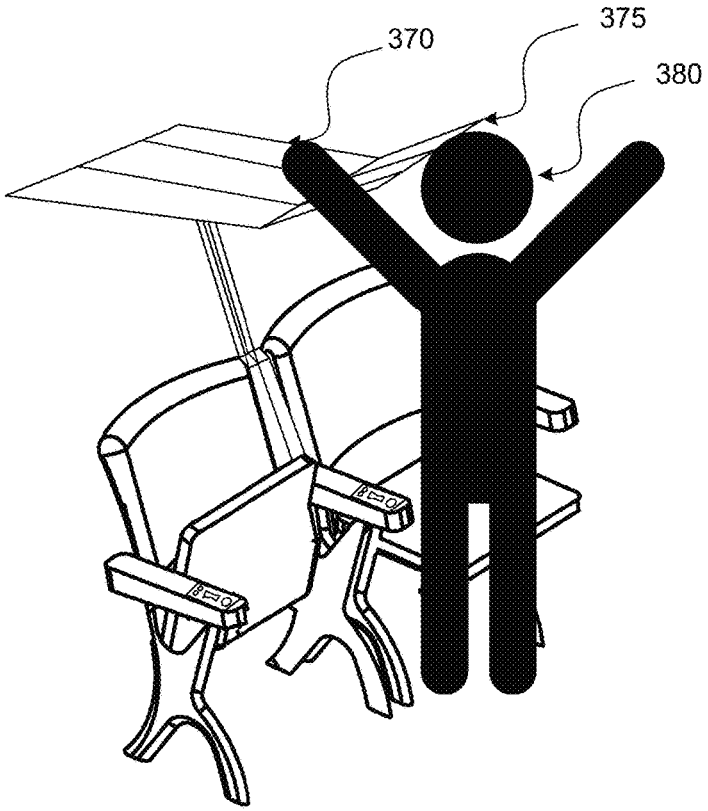
FIG. 3C illustrates venue seating with an exemplary adjustable seating apparatus with an adjustable flap.

Referring now to FIG. 3A-3C, venue seating 300 with an exemplary adjustable seating apparatus pocket 350, an exemplary adjustable seating apparatus 370, and an exemplary adjustable seating apparatus 370 with an adjustable flap 375, respectively, is illustrated. In some embodiments, venue seating 300 may include an adjustable seating apparatus pocket 350. In some implementations, venue seating 300 may include an exemplary adjustable seating apparatus 370. In some aspects, venue seating 300 may include an adjustable seating apparatus 370 with an adjustable flap 375. In some embodiments, venue seating 300 may include an adjustable seating apparatus pocket 350, an exemplary adjustable seating apparatus 370, and an adjustable flap 375. In some implementations, adjustable seating apparatus pocket 350, an exemplary adjustable seating apparatus 370, and an adjustable flap 375 may interact with one another.

In some aspects, an exemplary adjustable seating apparatus 370 with an adjustable flap 375 folds or collapses to limit water retention, whether from the elements, the venue, other patrons, or from some other source. In some implementations, an exemplary adjustable seating apparatus 370 may extend, collapse, fold, or adjust according to the weather, user input, venue input, or in response to action by a spectator, such as adjusting to a spectator's height. In some embodiments, the venue seating 300 may recognize proximate spectators, such as by sensors in the umbrella, sensors in the venue seating, being updated with information regarding ticket sales and to expect patrons in particular seats, or by manual inputs set by surrounding seats. In some aspects, venue seating 300 and its computational processing may be located at the base of the venue. In some embodiments, venue seating 300 and its computational processing may be contained or spread within the seating itself.

In some implementations, venue seating 300 may recognize or accept attributes of a spectator, such as height, whether the spectator is standing or sitting, where the spectator is with respect to a user's seating, and adjust based on these attributes to facilitate ease of viewing while accommodating the original user in the seat. In some aspects, a user may program the seating to account for spectators around them, or to respond to any requests from spectators about the venue seating, such as obscured vision. In some implementations, venue seating 300 may obtain its anticipated settings and information about seating from the venue itself, whether it originate from venue control operators, venue seating sensors, or programming that allows venue seating 300 to communicate with other venue seating. For example, if a spectator sits in a chair, the seat will then transmit information since it now senses weight in its place. Venue seating in front of this spectator may adjust and anticipate accordingly.

In some aspects the venue seating 300 may be responsive to an emergency condition, such as where the attendee 380 stands up in celebration. In some embodiments, one or both the adjustable seating apparatus 370 and the adjustable flap 375 may swing upwards to allow for that motion. In some implementations, in response to the emergency condition, an emergency release mechanism may place the adjustable seating apparatus 370 in a collapsed state, such as illustrated in FIG. 2C. In some embodiments, venue seating 300 may adapt to optimize condition shielding within the venue, wherein all responsive umbrellas may operate in uniform. For example, each adjustable seating apparatus 370 may be acting as individual parts to a larger covering. In some implementations, venue seating 300 may be individually customized by a spectator who may have access to a seat control. In some aspects, venue seating 300 may be wirelessly controlled by a spectator, using controls provided by the venue, through an application on a smart device, or with a control kiosk controlling the venue seating 300, as non-limiting examples. In some embodiments, venue seating 300 may be controlled solely by the event organizer or by a venue operator, who may tailor settings according to the event, the attendees, the weather, need, or other variables they may have to consider during an event at a venue. In some implementations, a user may request particular settings to a venue for venue seating 300 ahead of time to accommodate their requests, such as for special needs settings.

In some embodiments, venue seating 300 may be in the form of a foldable, portable object (not pictured). In some implementations, the foldable object may come in three interconnected segments, including, but not limited to, a cushion, a back rest, and an adjustable responsive umbrella or covering. In some aspects, these segments may be adjusted based on venue need or user preference. In some implementations, a user may replace interconnected segments for others with different functionality or to more easily clean the segments.

In some embodiments, a responsive umbrella may be integrated in a seating adapter, wherein the responsive umbrella may be connected to or slipped over a portion of a seat for temporary and portable use. For example, the responsive umbrella may be integrated into a seat cushion that may be slipped over the back of a venue seat, wherein a user may pull out the responsive umbrella when needed. In some aspects, the responsive umbrella may hook into a portion of the venue seating allowing a user or venue to easily attach and detach the responsive umbrella. This flexibility may allow for quick response to a change in ambient condition and for quick fitting to meet customer demand.

For example, a venue may rent out the foldable object for use in their seating. The venue may have open lighting and at times be simultaneously bright due to sunlight while also being cold due to wind or weather. A user can then activate heating functionality in the foldable object to warm up while also adjusting the covering portion to protect from sunlight. In some embodiments, the covering segment may include a handle to adjust the covering itself In some implementations, the covering segment may have solar powered functionality, such as functional fans to cool a user sitting in the sun. In some aspects, the foldable object may comprise a variety of materials, including, but not limited to plastics, nylon, rubber, silicone, aluminum, polymers, or microfiber.

Figure 4:
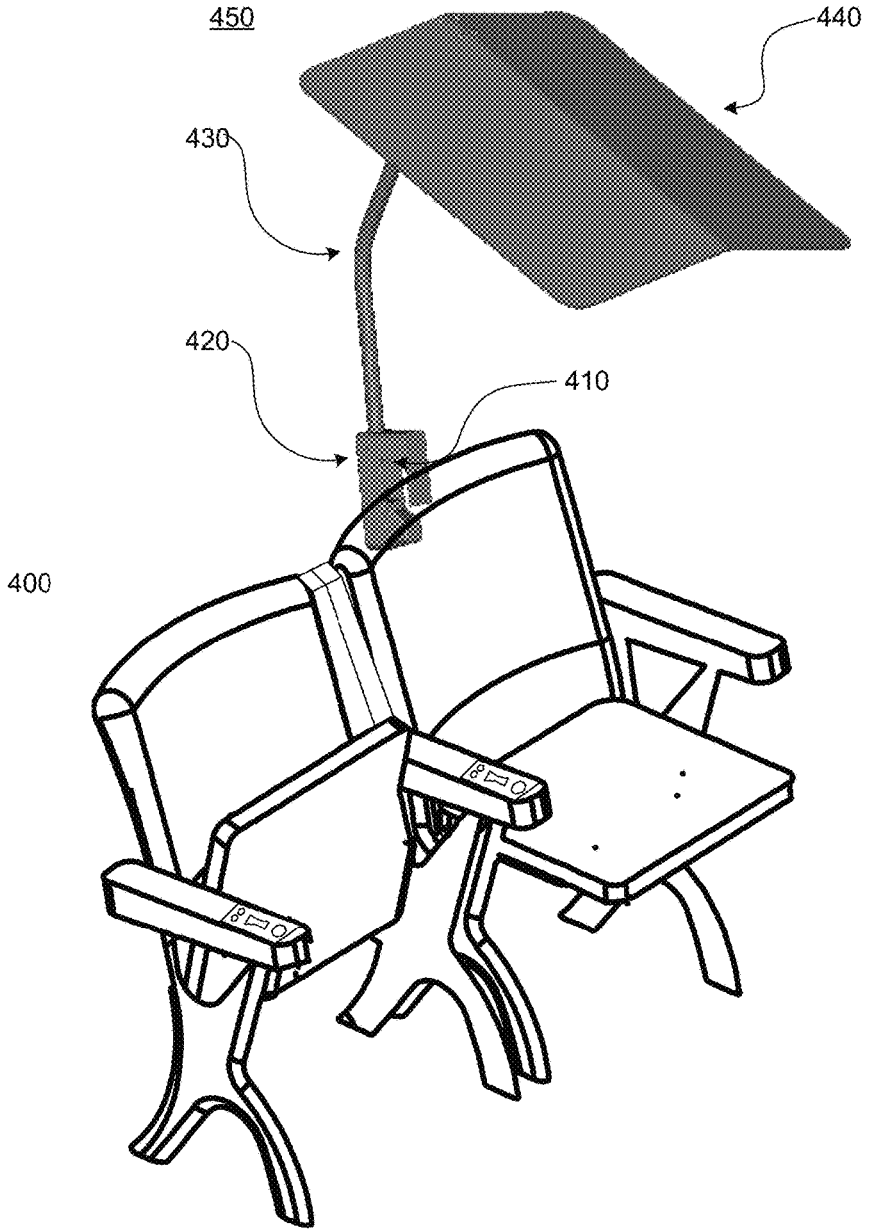
FIG. 4 illustrates venue seating with an exemplary adjustable seating apparatus with a locking mechanism.

Referring now to FIG. 4, venue seating 400 with an exemplary adjustable seating apparatus 450 with a locking mechanism 410 is shown. In some embodiments, an exemplary adjustable seating apparatus may include a locking mechanism 410, an attachment mechanism 420, an arm 430, and a visor 440. In some implementations, venue seating 400 may include an adjustable seating apparatus 450. In some aspects, venue seating 400 may include a locking mechanism 410 for an adjustable seating apparatus 450. In some embodiments, a locking mechanism 410 may be integrated into the venue seating 400 design. In some implementations, a locking mechanism 410 may be an attachment for venue seating 400.

In some aspects, venue seating 400 may allow for multiple adjustable seating apparatus 450 next to one another. In some embodiments, an adjustable seating apparatus 450 may be measured to fit within a single unit of venue seating 400. In some implementations, an adjustable seating apparatus 450 may restrict movement to fit within venue seating 400. In some aspects, an adjustable seating apparatus 450 may limit its height to not block those around the adjustable seating apparatus 450. In some embodiments, an adjustable seating apparatus 450 may restrict its range of motion to fit within venue seating 400 parameters.

Figure 5A:
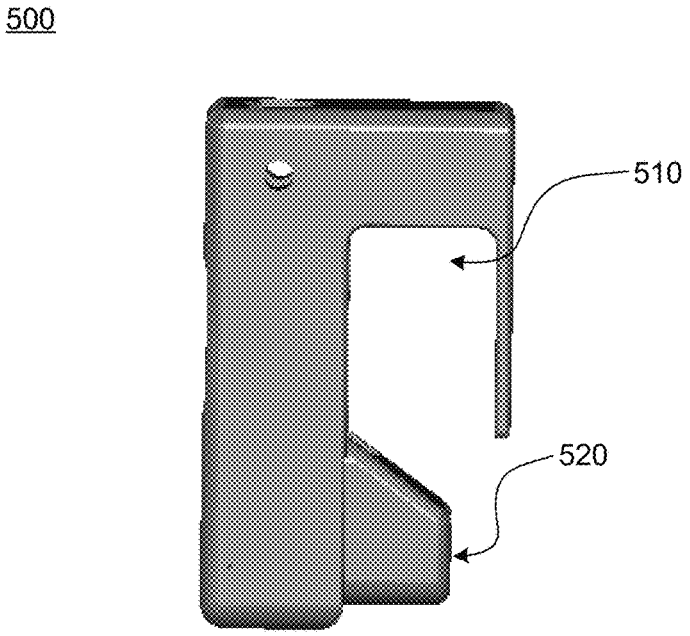
FIG. 5A illustrates a side view of an exemplary attachment mechanism with a lock.
Figure 5B:
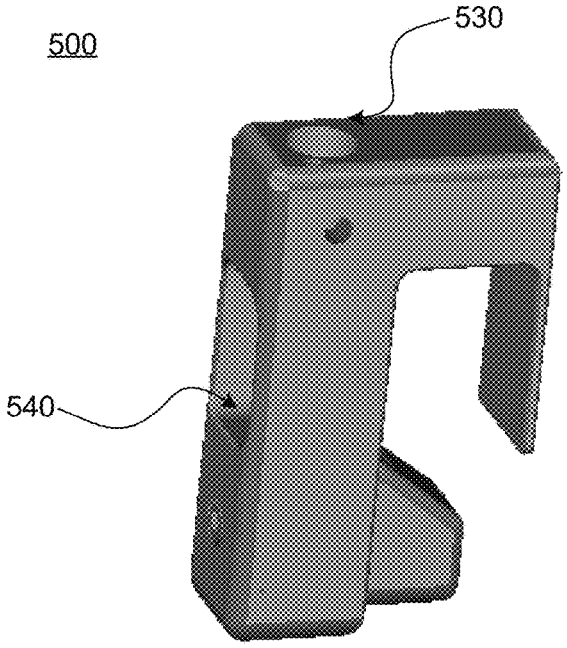
FIG. 5B illustrates a side view of an exemplary attachment mechanism with a lock.
Figure 5C:
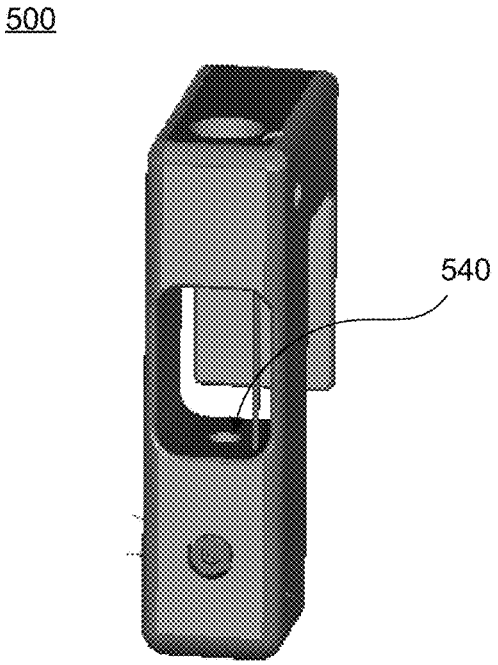
FIG. 5C illustrates a front view of an exemplary attachment mechanism with a lock.

Referring now to FIGS. 5A-5C, an exemplary attachment mechanism 500 with a lock is illustrated. In some embodiments, an attachment mechanism 500 may include a seat sleeve 510. In some implementations, an attachment mechanism 500 may include a securing mechanism 520. In some aspects, an attachment mechanism 500 may include an arm receiver 530. In some embodiments, an attachment mechanism 500 may include a lock release mechanism 540.

In some implementations, an attachment mechanism 500 may connect to an arm through an arm receiver 530 as described above. In some aspects, an attachment mechanism 500 may slide into venue seating. In some embodiments, a securing mechanism 520 may retract during installation. In some implementations, a securing mechanism 520 may click into place to indicate installation. In some embodiments, a securing mechanism 520 may be pulled or pushed to be engaged. In some aspects, a lock release mechanism 540 may require a key to disengage.

In some implementations, the lock release mechanism 540 may be mechanical. For example, the lock release mechanism 540 may comprise a magnetic mechanism, wherein a key may be magnetic and at least a portion of the lock release mechanism 540 may comprise a metal that the magnetic key may disengage to release the adjustable seating apparatus from the venue seating. In some aspects, the lock release mechanism 540 may be electronic.

Figure 6A:
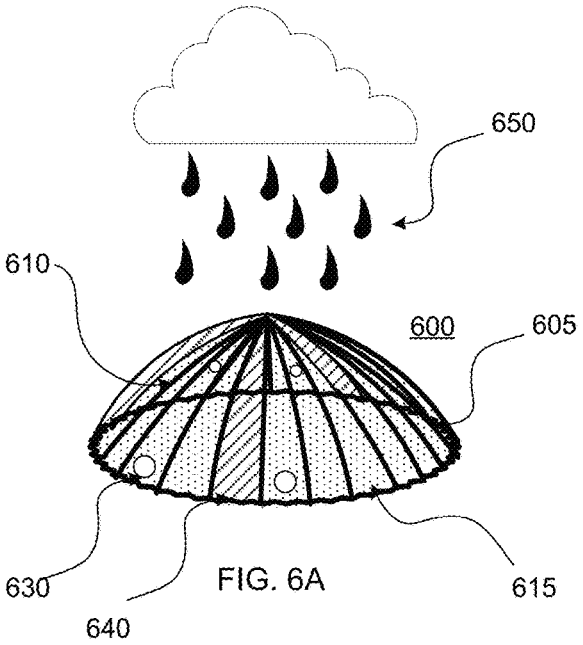
FIG. 6A illustrates an exemplary embodiment of a responsive umbrella according to some embodiments of the present invention.
Figure 6B:
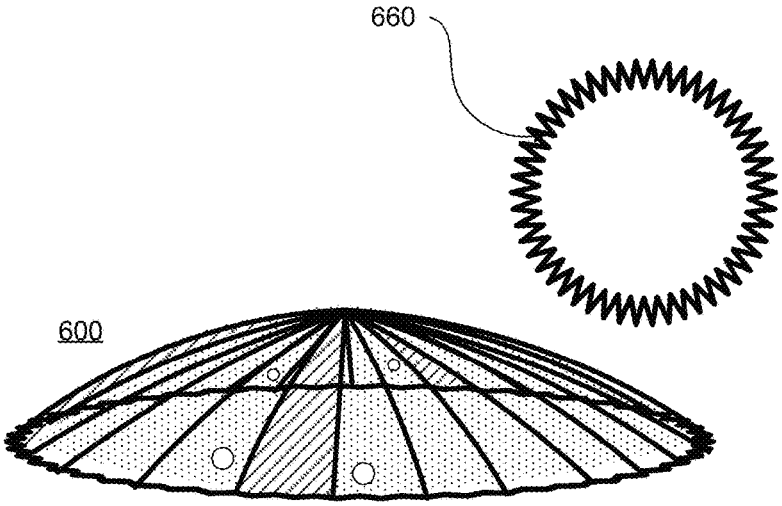
FIG. 6B illustrates an exemplary embodiment of a responsive umbrella according to some embodiments of the present invention.
Figure 6C:
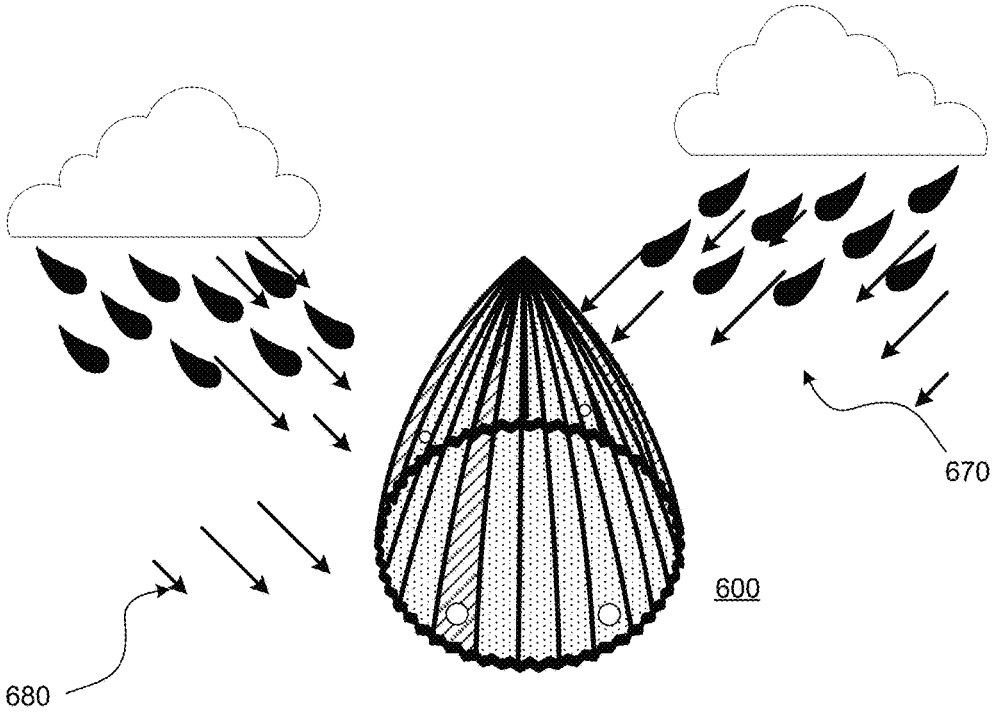
FIG. 6C illustrates an exemplary embodiment of a responsive umbrella according to some embodiments of the present invention.

Referring now to FIGS. 6A-6C, an exemplary responsive umbrella 600 is illustrated. In some aspects, a responsive umbrella 600 may comprise flexible and extendable ribs 610, wherein the ribs 610 may maintain a range of shapes and configurations. In some embodiments, the responsive umbrella 600 may comprise a flexible and expandable outer rim 605, wherein the outer rim 605 may maintain a range of shapes and configurations. In some aspects, the ribs 610 may comprise a variety of materials, including, but not limited to, metal, steel, wood, plastics, polymers, rubber, silicone, or aluminum.

In some implementations, the responsive umbrella 600 may comprise a flexible covering 615, wherein the covering 615 may be at least partially controlled by one or both the outer rim 605 and the ribs 610. In some aspects, the flexible covering 615 may comprise a variety of materials, including, but not limited to, plastics, nylon, rubber, silicone, aluminum, polymers, or microfiber. In some embodiments, the ribs 610 may be integrated into the covering 615, wherein the covering 615 between each rib 610 may form a panel 620. For example, the covering 615 may comprise a series of pockets that may house the ribs 610 or the ribs 610 may be manufactured into the material of the covering 615, such as through adhesion, welding, or other connective mechanisms.

In some aspects, one or more of the ribs 610 or panels 620 may comprise sensors 630 to detect predefined ambient conditions, such as, for example, rain, heat, humidity, UV rays, or wind. In some implementations, one or more the ribs 610 or panels 620 may comprise sensors 630 or communication protocols, such as near-field communications, to respond or react to other objects in close proximity and interact accordingly. For example, a user walking with a responsive umbrella may enter a subway, wherein the responsive umbrella collapses or shrinks to reduce its size in a confined place with a low ceiling. In some aspects, one or more panels may comprise an energy panel 640, wherein the energy panel 640 may collect power from ambient conditions, such as wind, solar, or thermal.

In some embodiments, panel appearance may be adjustable. As an illustrative example, the transparency level of one or more of the panel may be adjustable, such as based on ambient light levels or user settings. For example, where the ambient light levels are low, such as during a storm, the panel may be more transparent to allow for more light. In some aspects, the color of one or more panel may be adjustable, such as based on predefined ambient conditions or user settings. In some implementations, certain colors may provide additional functionality. For example, in hot weather, a panel may have a white exterior to reflect light and a black interior to more effectively absorb some of the heat and limit light permeation. In colder weather, the panels may be reversed or pivoted to harness or give the sensation or perception of maximizing heat. In some aspects, the color or colors may be adjustable.

In some aspects, such as illustrated in FIG. 6A, the responsive umbrella 600 may maintain a traditional umbrella configuration during rainfall 650 with little wind, where the primary functional requirement of the responsive umbrella 600 may be to shield a user from rain that may be generally perpendicular to the ground. In some embodiments, such as illustrated in FIG. 6B, the responsive umbrella 600 may extend to have a long diameter and shallow depth, where the primary functional requirement of the responsive umbrella 600 may be to limit sun 660 and heat exposure. The extended diameter may maximize protection but may be susceptible to other ambient conditions, such as wind or directional rain.

In some embodiments, such as illustrated in FIG. 6C, the responsive umbrella 600 may form a bubble-like configuration, wherein the outer rim may have a reduced diameter and may extend over the user. The covering 615 of the responsive umbrella 600 may surround the user limiting exposure to wind 680 and directional precipitation 670, such as rain, snow, or hail. The bubble-like configuration may limit the effect of strong ambient conditions on the functionality of the responsive umbrella 600.

For example, traditional umbrellas may be susceptible to winds that may tear the panels or flip the covering, which may damage one or more the ribs, panels, and coverings. In some aspects, one or more of the ribs 610 and the outer rim 605 may comprise a flexible material, such as plastic, rubber, or silicone, wherein the flexibility may allow for a wider tolerance range than would other rigid or less flexible materials. In some aspects, the flexible material may limit the chance of attracting lightning.

Figure 7:
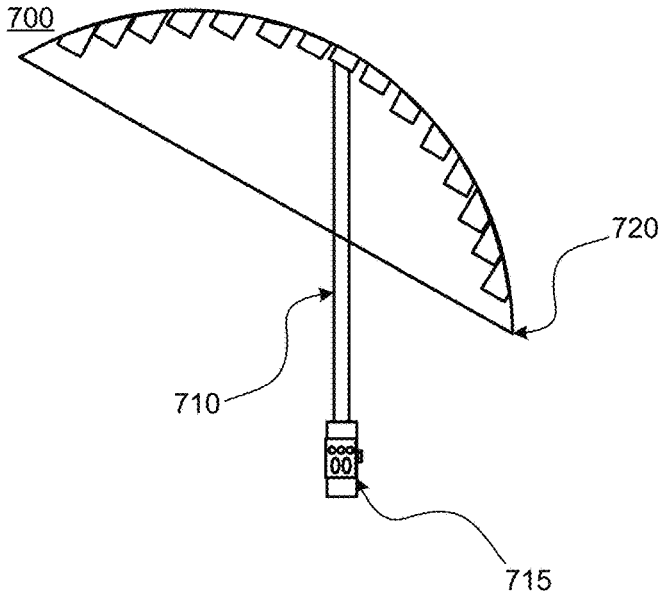
FIG. 7 illustrates an exemplary embodiment of a responsive umbrella with personal stem according to some embodiments of the present invention.

Referring now to FIG. 7, an exemplary responsive umbrella 700 with personal stem 710 is illustrated. In some aspects, the responsive umbrella 700 may appear similar to a traditional umbrella, wherein a personal stem 710 may extend from the center of the covering 720. In some embodiments, the personal stem 710 may comprise an operating pad 715, wherein a user may control at least a portion of the functionality of the responsive umbrella 700. For example, the operating pad 715 may allow a user to toggle the responsive umbrella 700 open and close or off and on, wherein the responsive umbrella 700 may be set to function without responsiveness. In some aspects, the operating pad 715 may allow a user to customize the functionality or manually configure responsive settings.

In some aspects, the operating pad 715 may comprise a display interface. In some embodiments, the operating pad 715 may wirelessly communicate with external devices, such as a smartphone, tablet, or desktop computer. In some implementations, the responsive settings may evolve over time based on analysis of data over time, allowing the responsive umbrella 700 to become more effective. For example, the responsive umbrella 700 may be pre-programmed with default settings for pre-defined conditions, and the user may adjust the settings based on preference or other variables. For example, the settings for a responsive umbrella 700 may be based on an average person with average height and weight and without secondary attributes, such as occupational conditions or ambient population density. If the user changes certain programming or settings, a responsive umbrella 700 may adjust accordingly in the future before the user reinitiates its settings, or it adapts according to certain environments or settings as defined by the user's previously set preferences. Over time, if a user continues to engage these settings consistently, the responsive umbrella 700 may adjust automatically.

In some embodiments, preferences and configurations may be linked to a profile or a user tab on a responsive umbrella 700. In some aspects, if preferences are linked to a profile, a responsive umbrella 700 may sense which user's smartphone is in proximity and link to that device. In some implementations, a user may select which profile to apply for a particular use, such as when a user loans a responsive umbrella 700 to a friend. In some embodiments, a responsive umbrella 700 may allow for multiple users, such as family members or employees in a construction company. In some aspects, a profile saved on a phone may be transferred and pre-programmed based on a prior profile when a new responsive umbrella 700 is activated. In some embodiments, a responsive umbrella 700 may be paired with global positioning system (GPS) technology to enable a user to locate a responsive umbrella 700 in situations where it may be lost or left behind.

Figure 8:
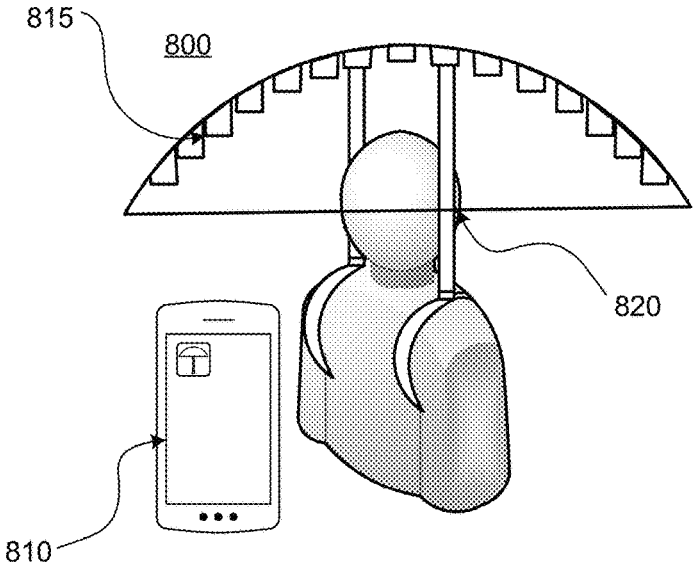
FIG. 8 illustrates an exemplary embodiment of a responsive umbrella with a modular stem system.

Referring now to FIG. 8, an exemplary responsive umbrella 800 with a modular stem system 810, wherein the modular stem system 810 comprises one or more stem slots 815 configured to accept one or more stems 820. In some aspects, the modular stem system 810 may allow a user to customize how the responsive umbrella 800 may be held. For example, a responsive umbrella 800 may be held in a traditional format when a single stem may be inserted into a center slot. In some aspects, a user may prefer a hands-free responsive umbrella 800, such as when she is performing an activity that may require use of both hands. In some embodiments, one or more stems may comprise a hands-free mechanism, such as shoulder or neck straps. For example, two stems with shoulder straps may be inserted to separate stem slots 815 based on the width of the user's shoulders. In some implementations, straps may comprise hook and loop fasteners, magnets, magnetic tape, synthetics, or other adhesive materials, as non-limiting examples.

In some aspects, a modular stem system 810 may be paired with a common object, such as a handbag, so that a responsive umbrella 800 may connect to it. In some implementations, a modular stem system 810 may allow for different forms of activating a responsive umbrella 800, such as hands-free activation, voice or sound activation, digital activation, or movement activation, as non-limiting examples. For example, as previously discussed, a modular stem system 810 may be inserted into a handbag to allow a user to use a hands-free responsive umbrella 800 wherein the covering itself may be activate by a user's chin. In some embodiments, a modular stem system 810 may attach to an occupational uniform item, such as a vest, belt, or safety sash, as non-limiting examples.

Figure 9:
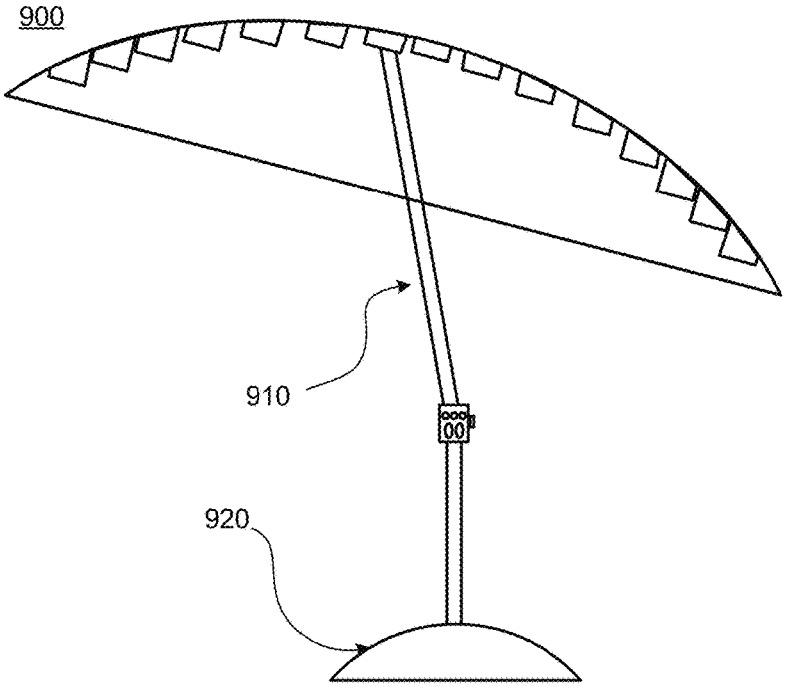
FIG. 9 illustrates an exemplary embodiment of a responsive umbrella with an adaptive stem.

Referring now to FIG. 9, an exemplary responsive umbrella 900 with an adaptive stem 910 is illustrated. In some aspects, a responsive umbrella 900 may be sized for a plurality of uses, such as a beach umbrella, a patio umbrella, or other group umbrellas. In some aspects, the functionality may be the same or similar to a personal responsive umbrella 900. In some embodiments, a responsive umbrella 900 may be adaptable between personal and group use. In some implementations, a personal stem may be replaced by a stabilizing stem, which may comprise a base 920 that may allow the responsive umbrella 900 to stand upright. In some aspects, such as with a beach stem, the stabilizing stem may comprise a pointed tip that may easily penetrate sand or dirt. In some embodiments, the stabilizing stem may comprise other stabilizing mechanisms, such as extenders that may expand radially into the ground or a weighted portion. In some implementations, the responsive umbrella 900 may expand and contract to be a personal umbrella and a group umbrella, wherein one or more the outer rim, panels, ribs, or covering may be extendable.

In some aspects, a user may program settings, through an item like a smart device or a responsive umbrella 900, for multi-use purposes. For example, if a user wants to change a responsive umbrella 900 from personal use to group use, they may choose an option for the responsive umbrella 900 to adjust to while preparing the adaptive stem 910 for the new use. In some embodiments, a user will be able to program both a responsive umbrella and an adaptive stem 910 for a variety of uses and have them adjust themselves accordingly without physical interaction from the user.

Figure 10:
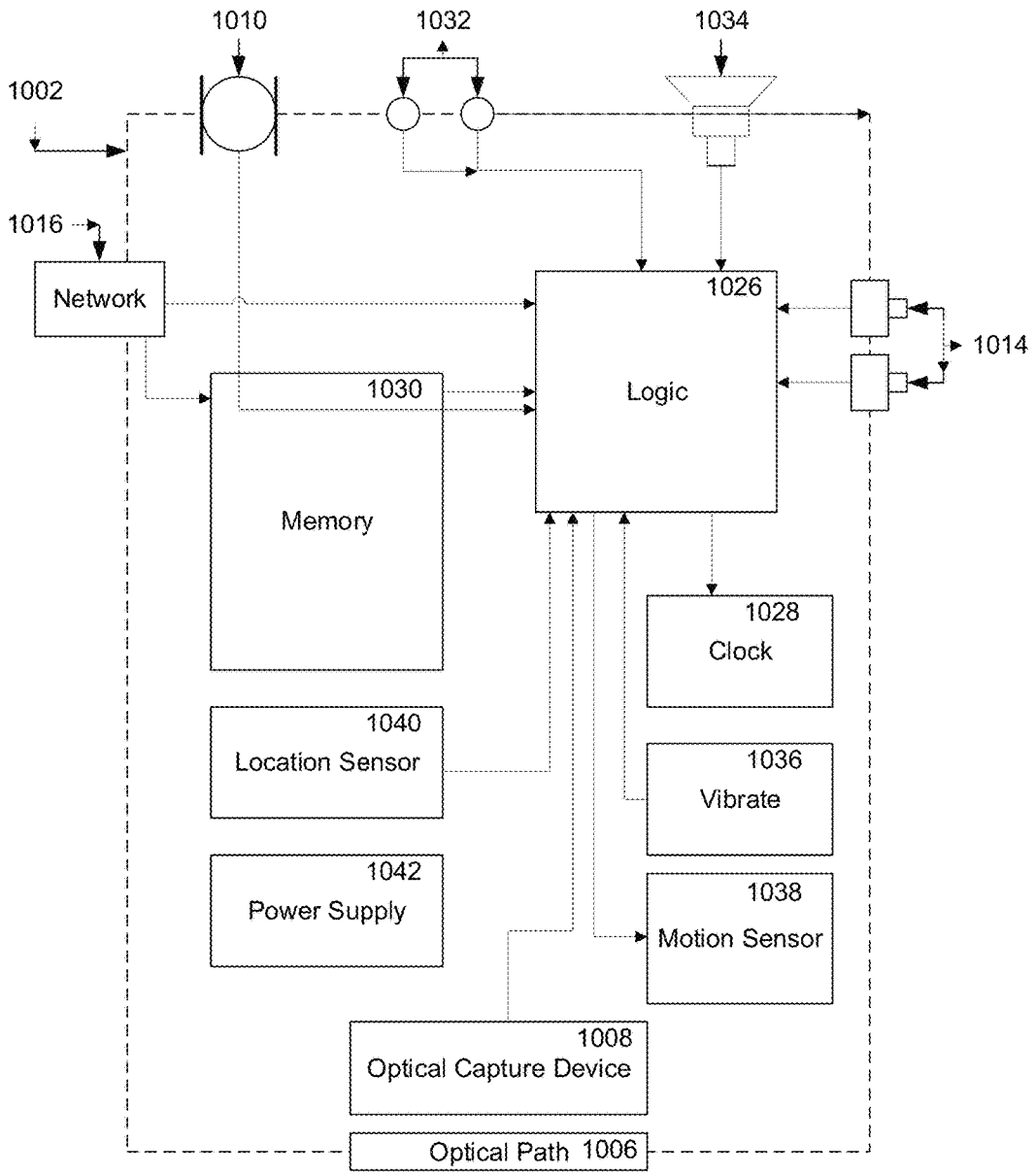
FIG. 10 illustrates an exemplary block diagram of an exemplary embodiment of a mobile device, according to some embodiments of the present disclosure.

Referring now to FIG. 10, an exemplary block diagram of an embodiment of a mobile device 1002 is illustrated. The mobile device 1002 may comprise an optical capture device 1008, which may capture an image and convert it to machine-compatible data, and an optical path 1006, typically a lens, an aperture, or an image conduit to convey the image from the rendered document to the optical capture device 1008. The optical capture device 1008 may incorporate a Charge-Coupled Device (CCD), a Complementary Metal Oxide Semiconductor (CMOS) imaging device, or an optical sensor of another type.

In some embodiments, the mobile device 1002 may comprise a microphone 1010, wherein the microphone 1010 and associated circuitry may convert the sound of the environment, including spoken words, into machine-compatible signals. Input facilities 1014 may exist in the form of buttons, scroll-wheels, or other tactile sensors such as touchpads. In some embodiments, input facilities 1014 may include a touchscreen display. Visual feedback 1032 to the user may occur through a visual display, touchscreen display, or indicator lights. Audible feedback 1034 may be transmitted through a loudspeaker or other audio transducer. Tactile feedback may be provided through a vibration module 1036.

In some aspects, the mobile device 1002 may comprise a motion sensor 1038, wherein the motion sensor 1038 and associated circuity may convert the motion of the mobile device 1002 into machine-compatible signals. For example, the motion sensor 1038 may comprise an accelerometer, which may be used to sense measurable physical acceleration, orientation, vibration, and other movements. In some embodiments, the motion sensor 1038 may comprise a gyroscope or other device to sense different motions.

In some implementations, the mobile device 1002 may comprise a location sensor 1040, wherein the location sensor 1040 and associated circuitry may be used to determine the location of the device. The location sensor 1040 may detect Global Position System (GPS) radio signals from satellites or may also use assisted GPS where the mobile device may use a cellular network to decrease the time necessary to determine location. In some embodiments, the location sensor 1040 may use radio waves to determine the distance from known radio sources such as cellular towers to determine the location of the mobile device 1002. In some embodiments these radio signals may be used in addition to and/or in conjunction with GPS.

In some aspects, the mobile device 1002 may comprise a logic module 1026, which may place the components of the mobile device 1002 into electrical and logical communication. The electrical and logical communication may allow the components to interact. Accordingly, in some embodiments, the received signals from the components may be processed into different formats and/or interpretations to allow for the logical communication. The logic module 1026 may be operable to read and write data and program instructions stored in associated storage 1030, such as RAM, ROM, flash, or other suitable memory. In some aspects, the logic module 1026 may read a time signal from the clock unit 1028. In some embodiments, the mobile device 1002 may comprise an on-board power supply 1042. In some embodiments, the mobile device 1002 may be powered from a tethered connection to another device, such as a Universal Serial Bus (USB) connection.

In some implementations, the mobile device 1002 may comprise a network interface 1016, which may allow the mobile device 1002 to communicate and/or receive data to a network and/or an associated computing device. The network interface 1016 may provide two-way data communication. For example, the network interface 1016 may operate according to an internet protocol or near-field communication, which may communicate with a monitor. As another example, the network interface 1016 may comprise a local area network (LAN) card, which may allow a data communication connection to a compatible LAN. As another example, the network interface 1016 may comprise a cellular antenna and associated circuitry, which may allow the mobile device to communicate over standard wireless data communication networks. In some implementations, the network interface 1016 may comprise a Universal Serial Bus (USB) to supply power or transmit data. In some embodiments, other wireless links known to those skilled in the art may also be implemented.

Figure 11:
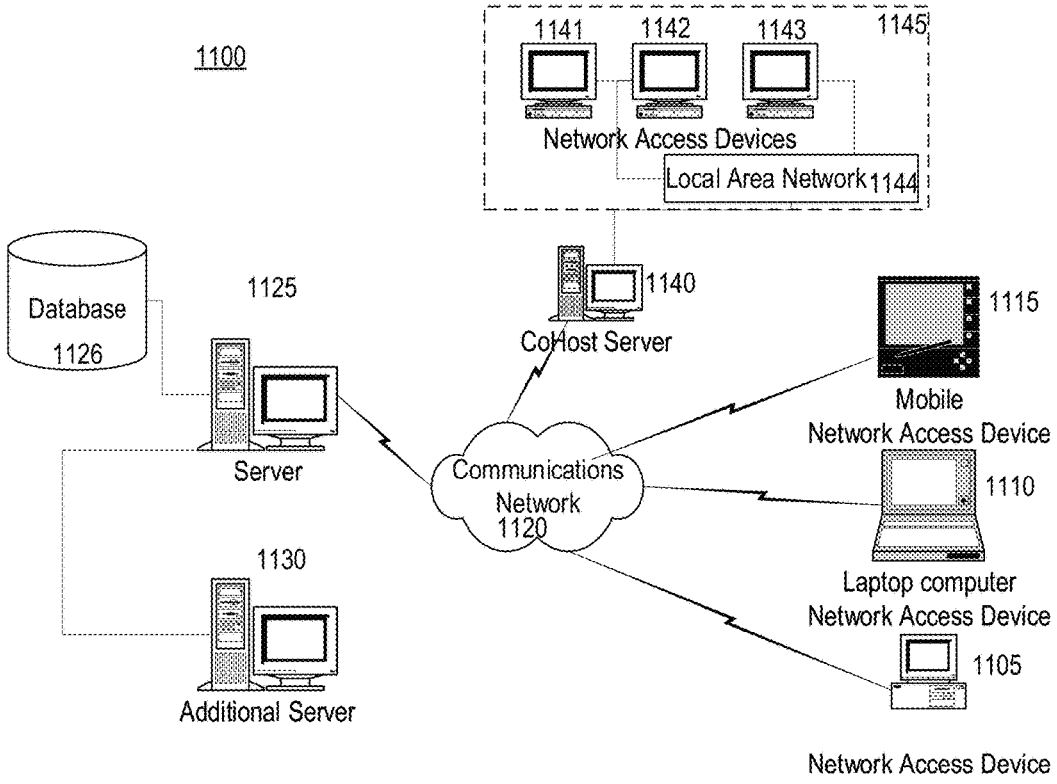
FIG. 11 illustrates apparatus that may be used to implement aspects of the present disclosure, including executable software.

Referring now to FIG. 11, an exemplary processing and interface system 1100 is illustrated. In some aspects, access devices 1115, 1110, 1105, such as a paired portable device 1115 or laptop computer 1110 may be able to communicate with an external server 1125 though a communications network 1120. The external server 1125 may be in logical communication with a database 1126, which may comprise data related to identification information and associated profile information. In some embodiments, the server 1125 may be in logical communication with an additional server 1130, which may comprise supplemental processing capabilities.

In some aspects, the server 1125 and access devices 1105, 1110, 1115 may be able to communicate with a cohost server 1140 through a communications network 1120. The cohost server 1140 may be in logical communication with an internal network 1145 comprising network access devices 1141, 1142, 1143 and a local area network 1144. For example, the cohost server 1140 may comprise a payment service, such as PayPal or a social network, such as Facebook or LinkedIn.

CONCLUSION

A number of embodiments of the present disclosure have been described. While this specification contains many specific implementation details, these should not be construed as limitations on the scope of any disclosures or of what may be claimed, but rather as descriptions of features specific to particular embodiments of the present disclosure.

Certain features that are described in this specification in the context of separate embodiments can also be implemented in combination or in a single embodiment. Conversely, various features that are described in the context of a single embodiment can also be implemented in combination in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous.

Moreover, the separation of various system components in the embodiments described above should not be understood as requiring such separation in all embodiments, and it should be understood that the described program components and systems can generally be integrated together in a single software product or packaged into multiple software products.

Thus, particular embodiments of the subject matter have been described. Other embodiments are within the scope of the following claims. In some cases, the actions recited in the claims can be performed in a different order and still achieve desirable results. In addition, the processes depicted in the accompanying figures do not necessarily require the particular order show, or sequential order, to achieve desirable results. In certain implementations, multitasking and parallel processing may be advantageous. Nevertheless, it will be understood that various modifications may be made without departing from the spirit and scope of the claimed disclosure.

What is claimed is:

1. An adjustable seating apparatus comprising:

a seat attachment mechanism attachable to venue seating;

a visor configured to shield at least a portion of ambient elements for a user seated in the venue seating when the adjustable seating apparatus is in a default engaged state;

an arm connecting the visor to the seat attachment mechanism; and a locking mechanism configured to secure the seat attachment mechanism to the venue seating, wherein the locking mechanism clicks onto the venue seating and requires a key to release the adjustable seating apparatus from the venue seating once the locking mechanism clicks onto the venue seating.

2. The adjustable seating apparatus of claim 1, wherein the visor comprises a flat surface.

3. The adjustable seating apparatus of claim 1, wherein the visor comprises a kinked surface.

4. The adjustable seating apparatus of claim 1, wherein the visor comprises a rigid material.

5. The adjustable seating apparatus of claim 1, wherein the arm comprises a kinked configuration.

6. The adjustable seating apparatus of claim1, wherein the locking mechanism comprises a magnetic release mechanism.

7. The adjustable seating apparatus of claim 1, further comprising a visor attachment mechanism configured to attach the visor to the arm.

8. The adjustable seating apparatus of claim 7, wherein the arm comprises a tubing configured to accept the visor attachment mechanism.

9. The adjustable seating apparatus of claim 7, further comprising a height adjustment mechanism configured to adjust a height from the seat attachment to the visor.

10. The adjustable seating apparatus of claim 9, wherein the height adjustment mechanism adjusts an extension of the visor attachment mechanism.

11. The adjustable seating apparatus of claim 9, further comprising a lateral angle adjustment mechanism configured to adjust a lateral angle from the arm to the visor with a fixed lateral range of motion, wherein the lateral range of motion is based at least in part on the venue seating.

12. The adjustable seating apparatus of claim 9, further comprising a vertical angle adjustment mechanism configured to adjust a vertical angle from the arm to the visor with a fixed vertical range of motion, wherein the vertical range of motion is based at least in part on the venue seating.

13. The adjustable seating apparatus of claim 12, wherein the vertical angle adjustment mechanism allows for adjustment for a range between the default engaged state and a collapsed state, wherein the visor is substantially parallel to the arm.

14. The adjustable seating apparatus of claim 12, wherein one or more the height adjustment mechanism, the vertical angle adjustment mechanism, and the lateral angle adjustment mechanism further comprise a safety release function configured to respond to an emergency condition.

15. The adjustable seating apparatus of claim 14, wherein the emergency condition comprises the user standing up.

16. The adjustable seating apparatus of claim 14, wherein the emergency condition comprises an object placed on the visor.

17. The adjustable seating apparatus of claim 14, wherein the safety release mechanism allows for a temporary vertical angle adjustment extending beyond the default engaged state.

18. The adjustable seating apparatus of claim 14, wherein the safety release mechanism places the adjustable seating apparatus in a collapsed state.

* * * * *